US006278790B1

(12) United States Patent
Davis et al.

(10) Patent No.: US 6,278,790 B1
(45) Date of Patent: Aug. 21, 2001

(54) ELECTROACOUSTIC TRANSDUCERS COMPRISING VIBRATING PANELS

(75) Inventors: Gillian Margaret Davis, Huntingdon; Thomas Lundie, St. Neots; Anthony Malcolm McDonald, Earith, all of (GB)

(73) Assignee: NCT Group, Inc., Linthicum, MD (US)

( * ) Notice: Subject to any disclaimer, the term of this patent is extended or adjusted under 35 U.S.C. 154(b) by 0 days.

(21) Appl. No.: 09/331,469

(22) PCT Filed: Nov. 11, 1997

(86) PCT No.: PCT/GB97/03090

§ 371 Date: Jun. 18, 1999

§ 102(e) Date: Jun. 18, 1999

(87) PCT Pub. No.: WO98/28942

PCT Pub. Date: Jul. 2, 1998

(51) Int. Cl.[7] ..... H04R 25/00

(52) U.S. Cl. ..... 381/398; 381/190; 381/431; 310/324

(58) Field of Search ..... 381/173, 174, 381/190, 191, 396, 398, 401, 408, 423, 424, 429, 431, FOR 154, FOR 162, FOR 163; 73/715, 721, 727; 310/311, 324, 320; 367/155, 157

(56) References Cited

U.S. PATENT DOCUMENTS

| | | | | |
|---|---|---|---|---|
| 4,198,550 | | 4/1980 | Matsuda et al. | 179/181 F |
| 4,751,419 | | 6/1988 | Takahata | 310/324 |
| 4,779,246 | * | 10/1988 | Dietzsch et al. | 381/190 |
| 4,899,390 | | 2/1990 | Takewa et al. | 381/154 |
| 4,969,197 | | 11/1990 | Takaya | 381/190 |
| 4,985,926 | * | 1/1991 | Foster | 381/190 |
| 4,997,058 | | 3/1991 | Bertagni | 181/166 |
| 5,081,683 | | 1/1992 | Torgeson | 381/203 |
| 5,291,460 | * | 3/1994 | Harada et al. | 381/190 |
| 5,376,853 | * | 12/1994 | Fushimi | 381/190 |
| 5,627,903 | * | 5/1997 | Porrazzo et al. | 381/431 |
| 5,953,438 | * | 9/1999 | Stevenson et al. | 381/431 |

FOREIGN PATENT DOCUMENTS

| | | |
|---|---|---|
| 56-056095 | 5/1981 | (JP) . |
| 58-007999 | 1/1983 | (JP) . |
| WO 96/35313 | 11/1996 | (WO) . |
| WO 97/09844 | 3/1997 | (WO) . |
| WO 97/09846 | 3/1997 | (WO) . |

* cited by examiner

*Primary Examiner*—Stella Woo
*Assistant Examiner*—Suhan Ni
(74) *Attorney, Agent, or Firm*—R. Michelle Larson

(57) ABSTRACT

An electro-acoustic transducer comprises first and second panels (18A,18B) each of which can be vibrated to generate sound, a frame (10) for mounting the panels, and first and second seals (20A,B) arranged between the frame and the edges of the panels for holding the panels in the frame, substantially isolating the frame acoustically from the edges of the panel, and substantially sealing the frame to the edges of the panel. One or more actuators (22), such as piezoelectric elements, are provided for receiving a driving signal and vibrating in response thereto, and the actuators are mechanically and acoustically coupled to the first panel at one or more locations remote from the edges of the first panel so that the first panel vibrates in response to vibration of the actuators. The second panel is mechanically and acoustically coupled to the first panel and/or to the actuators at one or more locations remote from the edges of the second panel so that the second panel also vibrates in response to vibration of the actuator means. The acoustic properties of the panels, the seals, the actuators and the couplings can be chosen to obtain a required frequency response from the transducer. Different embodiments are described in which the panels are driven in phase, in anti-phase, and in a more complex manner.

68 Claims, 7 Drawing Sheets

ELECTROACOUSTIC TRANSDUCERS COMPRISING VIBRATING PANELS

FIELD OF THE INVENTION

This invention relates to electro-acoustic transducers for generating acoustic waves. An audio loudspeaker is an example of such a transducer. More particularly, the invention relates to transducers which include a panel, such as a flat panel, which can be vibrated to generate sound and one or more actuators for receiving a driving signal and vibrating in response thereto, the actuator(s) being coupled to the panel at one or more locations remote from the edges of the panel so that the panel vibrates, in response to the vibration of the actuators(s), in a multi-modal, non-pistonic, bending manner without any significant bodily translational movement of the panel.

DESCRIPTION OF RELATED ART

Such transducers are known in which the panel is made to vibrate in a multi-modal, non-pistonic manner, ie with bending vibrations in the panel rather than any significant bodily translational movement of the panel. In order to prevent any significant bodily translational movement, the panel is either rigidly clamped in a rigid frame, or is supported in a frame by a soft elastic suspension at its corners. A problem with such transducers, and with which a first aspect of the present invention is concerned, is that sound is generated from both sides of the panel and is allowed to interfere. Thus, if the panel is placed near an acoustically reflective surface, for example a wall, considerable interference can take place between the sound generated from the front of the panel and the sound generated from the back of the panel.

BRIEF SUMMARY OF THE INVENTION

In accordance with a first aspect of the present invention, a frame is provided for mounting the panel, and a seal is arranged between the frame and the edges of the panel for holding the panel in the frame, substantially isolating the frame acoustically from the edges of the panel, and substantially sealing the frame to the edges of the panel. Thus, acoustic vibrations in the air generated by the front and rear faces of the panel can be acoustically isolated and prevented from interfering, whilst acoustic reflections at the edges of the panel can be reduced. In other words, the seal can act as a barrier to acoustic vibrations passing around the panel member, and also act to damp out acoustic reflections at the interface between the panel and the frame, thus acting as a semi-anechoic termination.

(It should be noted that patent document JP-A-58-007999 shows a flat-plate transducer, the plate being arranged to vibrate in a single-mode, pistonic, bending manner with significant bodily translational movement of the plate, and the plate being mounted to a frame by peripheral rubber ring.)

Preferably, the seal comprises a strip of flexible resilient material, which may be arranged to wrap around the edges of the panel. (It should be noted that patent document JP-A-56-056095 discloses a different type of transducer, but with a vibratable plate mounted edge-to-edge inside a frame with an H-section element between the edges.) The strip may be received in a channel in the frame, and the strip may provide a channel which receives the edges of the panel. Conveniently, the strip may be formed from a length of resilient tubing, for example of silicone rubber, cut lengthwise and opened to clamp over the edges of the panel.

In some embodiments, the frame forms part of an enclosure disposed generally to one side of the panel. Thus, the enclosure can be arranged to absorb and damp out vibrations produced from one side of the panel, and sound can be radiated from the other side of the panel, with the seal substantially preventing sound from escaping from the enclosure to the outside.

The transducer may further include: a second panel which can be vibrated to generate sound and which is mounted to the frame; second coupling means for mechanically and acoustically coupling the second panel to the first panel and/or the actuator means at one or more locations remote from the edges of the second panel so that the second panel also vibrates, in response to vibration of the actuator means, in a multi-modal, non-pistonic, bending manner without any significant bodily translational movement of the second panel; and a second seal arranged between the frame and the edges of the second panel for holding the second panel in the frame, substantially isolating the frame acoustically from the edges of the second panel, and substantially sealing the frame to the edges of the second panel. If the first and second panels are parallel to each other, then the first and second seals can prevent sound generated in the space between the panels from escaping to interfere with sound generated from the other sides of the panels. If the first and second panels are side-by-side, then the seals have the same effect as if there were only one panel. (It should be noted that patent document WO-A-96-35313 shows a transducer having a pair of parallel panels rigidly fixed to a frame and bridged by an actuator which causes each panel to vibrate in a single mode, pistonic, bending manner with significant bodily translational movement of the panels.)

The first and second seals may have different acoustic isolation properties to assist in providing a flatter frequency response for the transducer as a whole, so that, for example, a trough in the frequency response of one of the panels coincides with a peak in the frequency response of the other panel.

A second aspect of the present invention is concerned with making other improvements to known electro-acoustic transducers of the type described in the opening paragraph. In accordance with the second aspect of the present invention, there is provided an electro-acoustic transducer, comprising: first and second panels each of which can be vibrated to generate sound; actuator means for receiving a driving signal and vibrating in response thereto; first coupling means for mechanically and acoustically coupling the first panel to the actuator means at one or more locations remote from the edges of the first panel so that the first panel vibrates, in response to vibration of the actuator means, in a multi-modal, non-pistonic, bending manner without any significant bodily translational movement of the panel; and second coupling means for mechanically and acoustically coupling the second panel to the first panel and/or the actuator means at one or more locations remote from the edges of the second panel so that the second panel also vibrates, in response to vibration of the actuator means, in a multi-modal, non-pistonic, bending manner without any significant bodily translational movement of the second panel. The first and second panels may therefore have different acoustic properties and/or the first and second coupling means may have different acoustic coupling properties to assist in providing a flatter frequency response for the transducer, again, for example, by arranging that a trough in the frequency response of one of the panels coincides with a peak in the frequency response of the other panel.

It should be noted that features of the first and second aspects of the invention described above may be combined in a single transducer.

In some embodiments of either aspect of the invention, the first and second panels are arranged face-to-face. In this case, the second coupling means may be arranged to couple the second panel mechanically and acoustically to the first panel. In one embodiment, the second panel has at least one aperture therein which receives the actuator means. Alternatively, the second coupling means may be arranged to couple the second panel mechanically and acoustically to the actuator means. In this case, the actuator means may be common to the first and second panels and may comprise at least one piezo-electric actuator bridging between the first and second coupling means. In this case, the, or at least one of the, piezo-electric actuators may comprise a stack formed of layers of piezoelectric material.

In other embodiments, the first and second panels are arranged side-by-side, and the second coupling means is arranged to couple the second panel mechanically and acoustically to the actuator means. (It should be noted that patent document U.S. Pat. No. 4,899,390 shows a different type of transducer, but with panels arranged side-by-side.)

In either case, the actuator means may comprise: a first actuator means which is coupled by the first coupling means to the first panel; and second actuator means which is coupled by the second coupling means to the second panel. In this case, the first and second actuator means may each comprise at least one piezo-electric actuator.

In any of the embodiments wherein a plurality of such piezo-electric actuators are provided, the, or at least two of the, piezo-electric actuators may have different electro-acoustic transducing properties, and again this may be used to achieve a flatter frequency response for the transducer as a whole.

Also, in any of the embodiments wherein a plurality of such piezo-electric actuators are provided, an electrical circuit may be provided for receiving an input signal and for producing therefrom at least two output signals with different amplitudes, frequency characteristics and/or phases, the output signals being supplied to different ones of the piezo-electric actuators, and again this may be used to achieve an improved frequency response for the transducer as a whole.

In any of the embodiments having a pair of such vibratable panels, the first and second panels may be arranged to vibrate substantially in phase with each other, and thus may act together like a single panel, but with an improved frequency response.

Alternatively, the first and second panels may be arranged to vibrate substantially in anti-phase with respect to each other. This may be particularly useful in the case where one of the panels faces towards an acoustically reflective surface, such as a wall, because the sound reflected from the surface can be arranged to interfere constructively with the sound radiated forwardly from the transducer.

At least one further panel may be provided, arranged face-to-face with respect to the first panel and/or arranged side-by-side with respect to the first panel.

The, or at least one of the, coupling means may be provided by bonding a respective portion of the, or the respective, actuator means to the, or the respective, panel, or may comprise a passive intermediate layer disposed between a respective portion of the, or the respective, actuator means and the, or the respective, panel. In this latter case, the, or at least one of the, intermediate layers preferably has larger lateral dimensions than the respective piezo-electric actuator and/or has a greater stiffness than the respective panel and substantially the same stiffness as the respective piezo-electric actuator.

BRIEF DESCRIPTION OF THE SEVERAL VIEWS OF THE DRAWINGS

Specific embodiments of the present invention will now be described, purely by way of example, with reference to the accompanying drawings, in which.

DETAILED DESCRIPTION OF THE INVENTION

Figure 1:
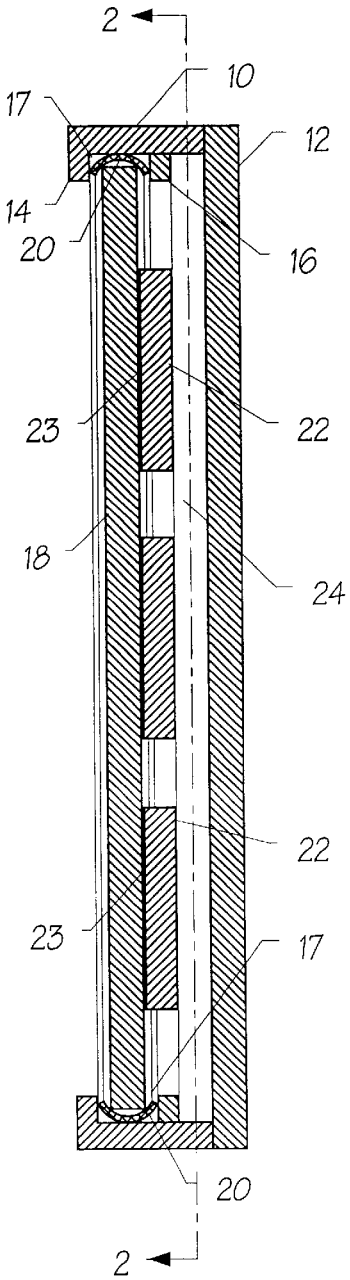
FIG. 1 is a sectioned side view of a first embodiment of electro-acoustic transducer, taken along the section line 1—1 in FIG. 2.
Figure 2:
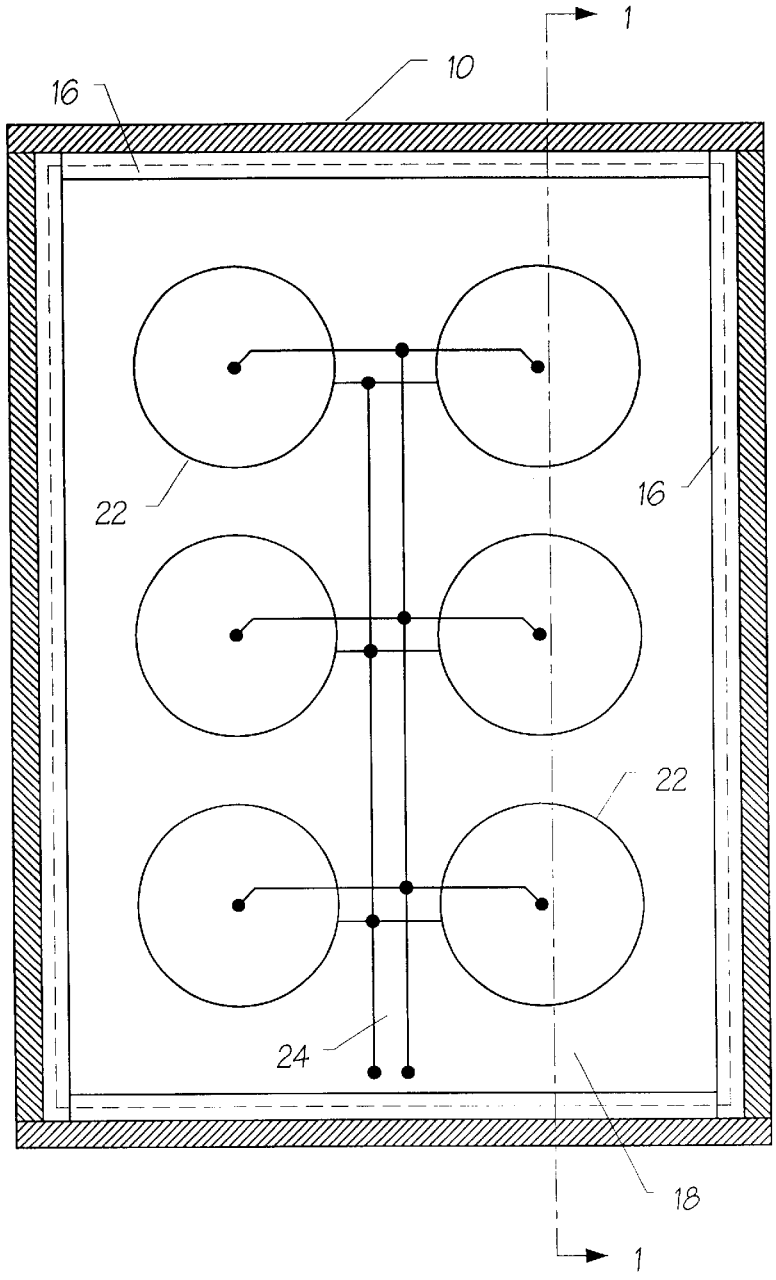
FIG. 2 is a sectioned rear view of the electro-acoustic transducer of FIG. 1, taken along the section line 2—2 in FIG. 1.

Referring to FIGS. 1 and 2, the first embodiment of electro-acoustic transducer in the form of a loudspeaker comprises a rectangular frame 10 which is fixed to a rectangular back panel 12 and which are designed to be hung on a wall. The front edge of the frame 10 has inwardly facing lips 14, and battens 16 are secured around the inside of the frame 10 so that channels 17 are formed between the lips 14 and the battens 16. The transducer also includes a rectangular vibratable panel 18, the outside dimensions of which are slightly smaller than the inside dimensions of the rectangular frame 10. A seal 20 is provided around the edge of the vibratable panel 18. The seal 20 is formed from a length of silicone rubber tubing which has been cut along its length, opened out and clamped around the edges of the panel 18. The seal 20 is engaged in the channels 17 between the lips 14 and the battens 16, and thus the panel 18 is held in place in the frame 10, with the seal 20 isolating the frame 10 acoustically from the edges of the panel 18 and sealing the frame 10 to the edges of panel 18. The seal 20 permits very slight movement of the edges of the panel 18 towards and away from the back panel 12, and also permits the edges of the panel 18 to twist slightly in the channels 17 to accommodate multi-modal bending vibration of the panel 18.

An array of six piezoelectric actuators 22 are secured by adhesive 23 to the rear face of the vibratable panel 18. The actuators 22 are connected together in parallel by wires to a source (not shown) of a high voltage audio driving signal. In response to the driving signal, the piezoelectric material of the actuators 22 bends at the frequency of the driving signal, thereby causing the panel 18 to vibrate. The panel 18 vibrates predominantly in a non-pistonic, multi-modal manner by bending, rather than by bodily translation. This bending is facilitated by the seal 20 between the frame 10 and the edges of the panel 18. Furthermore, the seal 20 damps out acoustic reflections which may occur at the boundary between the panel 18 and the frame 10 and thus acts as a semi-anechoic termination. Such acoustic reflections would otherwise cause interference with the vibrations in the panel 18 and thus affect the performance of the transducer.

A cavity 24 is formed between the vibratable panel 18 and the back panel 12, and the cavity 24 may be filled with acoustic damping material to damp out acoustic vibrations generated rearwardly from the rear face of the vibratable panel 18. Also, the back panel 12 itself may be made from acoustic damping material.

The frame 10 should be as rigid as possible, and may be made of, for example, wood, metal or plastics material. As mentioned above, the panel 18 must be able to vibrate, and it may be made of any suitable rigid, but resilient, material, such as plastics, wood, card, cardboard, or a composite material consisting of two lightweight skins of high stiffness (Young's modulus) separated and connected by a lightweight core of either an open or closed cell. The panel 18 and frame 10 may be painted, can have a picture applied thereto, or can be suitably decorated in some other manner in order to provide an unobtrusive, aesthetically pleasing and decorative panel.

The frequency response of the transducer is dependent, amongst other things, upon the size, shape, density and stiffness of the vibratable panel 18, the sizes, shapes, positions and number of the piezoelectric actuators 22, the bonding of each of the piezoelectric actuators 22 to the panel 18 by the adhesive 23, the compliance of the seal 20, and the damping provided by the cavity 24 and back panel 12. Accordingly, the frequency response of the transducer can be adjusted by changing these parameters.

Figure 3:
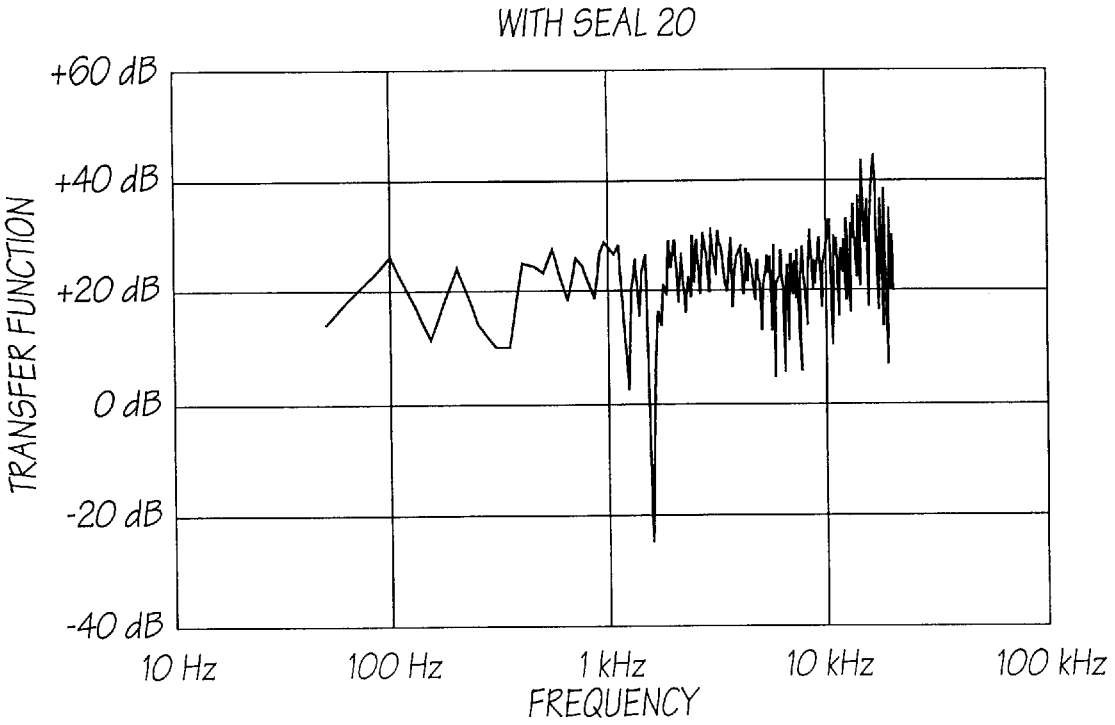
FIG. 3 is a graph of the transfer function, as a function of frequency, of an example of the transducer of FIGS. 1 and 2.
Figure 4:
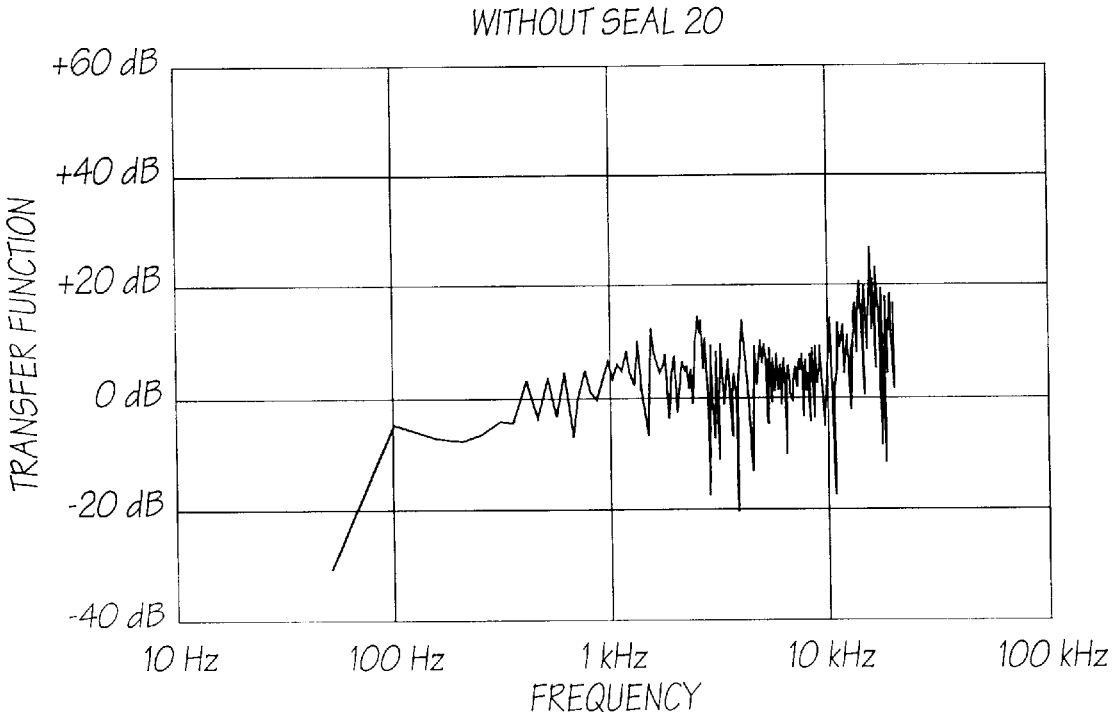
FIG. 4 is a graph of the transfer function, as a function of frequency, of an example of the transducer of FIGS. 1 and 2, but modified to secure the panel rigidly to the frame.

FIG. 3 illustrates the transfer function of an example of the transducer of FIGS. 1 and 2. As can be seen, the frequency response of the transducer is reasonably flat, which is a desirable feature for loudspeaker applications for the transducer. By comparison, FIG. 4 illustrates the transfer function for an example of the transducer which was similarly constructed, except that the panel 18 was secured to the frame 10 without the use of a seal 20. As can be seen, the frequency response of this latter transducer is not so flat and has a poorer performance at low frequencies, particularly below 1 kHz.

It has been found that an additional unexpected advantage of the strip of flexible resilient material is that unwanted sibilance is removed and the quality of sound radiated from the transducer is improved.

Figure 5:
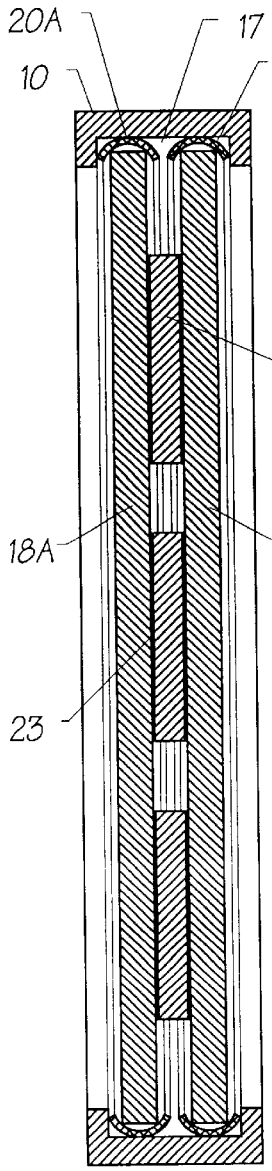
FIGS. 5 to 13 are each sectioned side views of further embodiments of electro-acoustic transducers.

FIG. 5 shows another embodiment which is similar to the embodiment of FIGS. 1 to 2, except that first and second vibratable panels 18A,B are provided, and the fixed back panel 12 is omitted. It should be understood that such a fixed back panel 12 may be added to damp out acoustic vibrations generated rearwardly from the combination of the vibratable panels 18A,B, as described above with reference to FIGS. 1 and 2. The inner face of the first vibratable panel 18A is secured by adhesive 23 to a first face of each of the piezoelectric actuators 22, and the inner face of the second vibratable panel 18B is secured by adhesive 23 to the other face of each of the piezoelectric actuators 22. Accordingly, the piezoelectric actuators 22 directly drive the two vibratable panels 18A,B in phase. Each of the vibratable panels 18A,B has a respective seal 20A,B provided around its edges, and both of the seals 20A,B are engaged in a common channel 17 provided in the frame 10.

The frequency responses of the two panels 18A,B may be made to differ so as to achieve a flatter frequency response for the transducer as a whole. For example, peaks in the frequency response of one of the panels 18A,B can be arranged to coincide with troughs in the frequency response on the other panel, thereby providing a flatter frequency response for the transducer as a whole. This may be done by constructing the two panels 18A,B from different materials having different stiffnesses and/or densities, by using panels 18A,B having different thicknesses and/or face areas, by using seals 20A,B having different stiffnesses and/or by using different adhesives to bond the piezoelectric actuators 22 to the two panels 18A,B.

Figure 6:
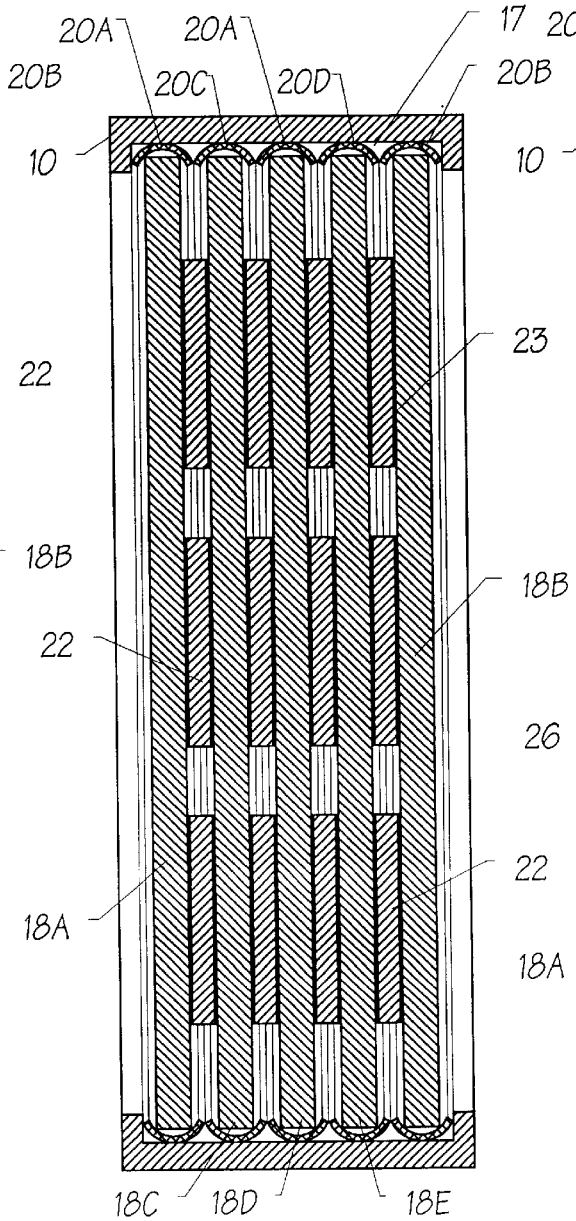

FIG. 6 shows a further embodiment which is similar to the embodiment of FIG. 5, except that five of the vibratable panels 18A–E are provided parallel to each other. Each panel 18A–E has a respective seal 20A–E, and the seals 20A–E are engaged in a common channel 17 in the frame 10. Adjacent pairs of the panels 18A–E are secured by adhesive 23 to the opposite faces of each of six piezoelectric actuators 22 therebetween.

In addition to the steps described above for affecting the overall frequency response of the transducer, with the embodiment of FIG. 6, the overall frequency response may also be affected by using piezoelectric actuators 22 between some of the adjacent pairs of vibratable panels 18A–E which have a different thickness to that of the piezoelectric actuators 22 between others of the adjacent pairs of vibratable panels 18A–E, and/or by employing different numbers of the piezoelectric actuators 22 between different adjacent pairs of the panels 18A–E.

Figure 7:
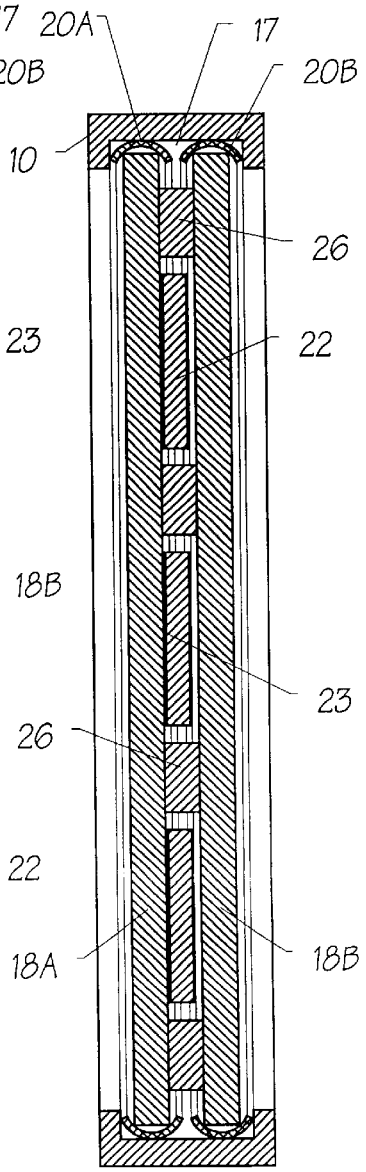

FIG. 7 shows another embodiment which is similar to the embodiment of FIG. 5, except that only the first vibratable panel 18A is directly driven by the piezoelectric actuators 22. The second vibratable panel 18B is acoustically coupled to the first vibratable panel 18A by one or more acoustic links 26 and is held spaced apart from the piezoelectric actuators 22. Accordingly, the second vibratable panel 18B is indirectly driven by the piezoelectric actuators 22 via the first vibratable panel 18A and the acoustic link(s) 26.

In addition to the features described above which affect the overall frequency response of the transducer, with the embodiment of FIG. 7, the overall frequency response can also be affected by the degree of acoustic coupling provided by the or each acoustic link 26, and the number and positions of the acoustic links 26.

Figure 8:
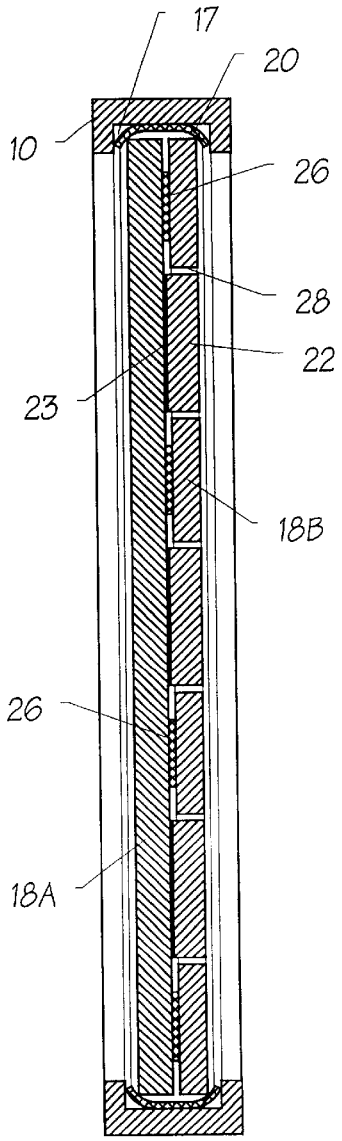

FIG. 8 shows a yet further embodiment which is similar to the embodiment of FIG. 7 except that the second vibratable panel 18B is formed with holes 28 in which the piezoelectric actuators 22 are received without contact. The acoustic link(s) 26 can therefore be made thinner than in the embodiment of FIG. 7, and may be provided by blobs of adhesive. Accordingly, the embodiment of FIG. 8 can be manufactured with a slimmer profile than the embodiment of FIG. 7. It will also be noted that in the embodiment of FIG. 8, a single seal 20 may be employed which embraces both vibratable panels 18A,B.

Figure 9:
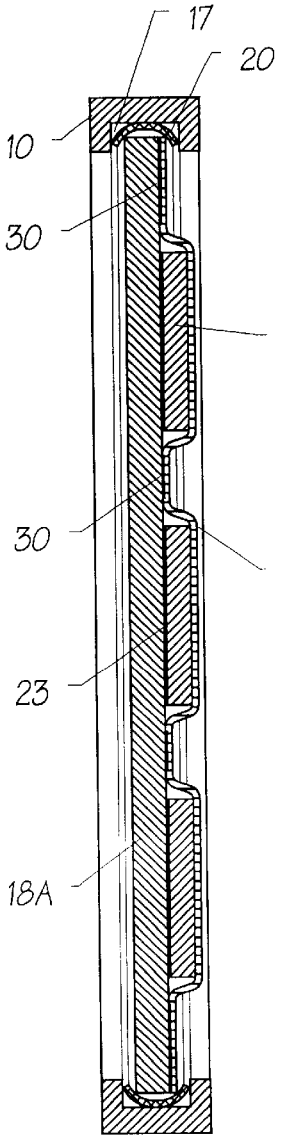

FIG. 9 shows yet another embodiment which is similar to the embodiment of FIG. 8, except that the second vibratable panel 18B is provided by a thinner membrane which conforms to the rear surface of the first panel 18A and the piezoelectric actuators 22 which are fixed thereto. The membrane 18B is bonded to the first panel 18A at regions 30 intermediate the piezoelectric actuators 22. Alternatively or additionally, bonded regions 30 may be provided on the piezoelectric actuators 22. The bonded regions 30 may be at odd spots over the panel structure. The membrane 18B may be of an accoustically lossy material, such as felt. A single seal 20 is shown in FIG. 9, which embraces the edges of the first panel 18A and the membrane 18B. Alternatively, the edge of the membrane 18B may be arranged to stop short of the edge of the first panel 18A, with the seal then embracing only the edge of the first panel 18A.

Figure 10:
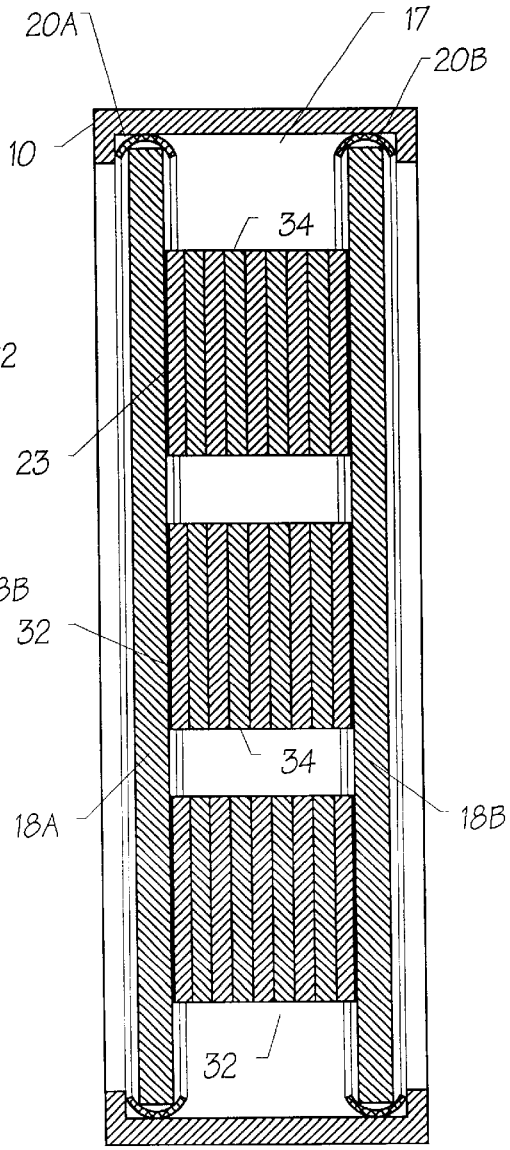

FIG. 10 shows another embodiment which is similar to the embodiment of FIG. 5, except that the first and second panels 18A,B are spaced wider apart, and each of the piezoelectric actuators 22 of FIG. 5 is replaced by a piezoelectric stack 32. Each of the stacks 32 has a plurality of parallel layers 34 of piezoelectric material which are bonded together so as to bend in response to an applied electrical signal, and this can provide an enhanced driving force to the vibratable panels 18A,B.

Figure 11:
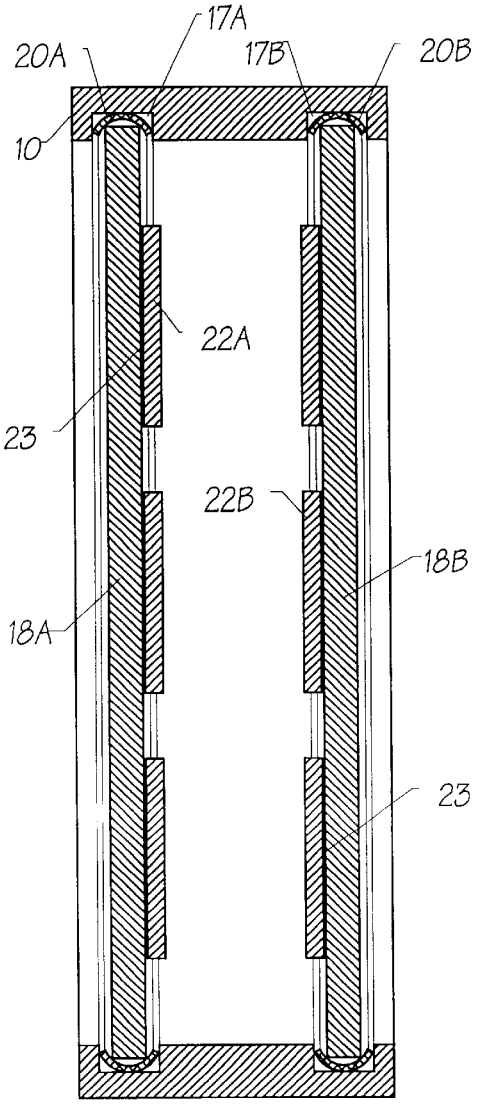

FIG. 11 shows a further embodiment which is similar to the embodiment of FIG. 10, except that the seals 20A,B of the vibratable panels 18A,B are engaged in respective channels 17A,B in the frame 10, and each of the vibratable panels 18A,B is provided with its own piezoelectric actuators 22A,B, rather than sharing the piezoelectric stacks 32 of FIG. 10 with each other.

In addition to the steps described above which affect the overall frequency response of the transducer, with the embodiment of FIG. 11, the overall frequency response can also be affected by using piezoelectric actuators 22A,22B for the two vibratable panels 18A,B which differ, for example with regard to number, shape, size and position.

Figure 12:
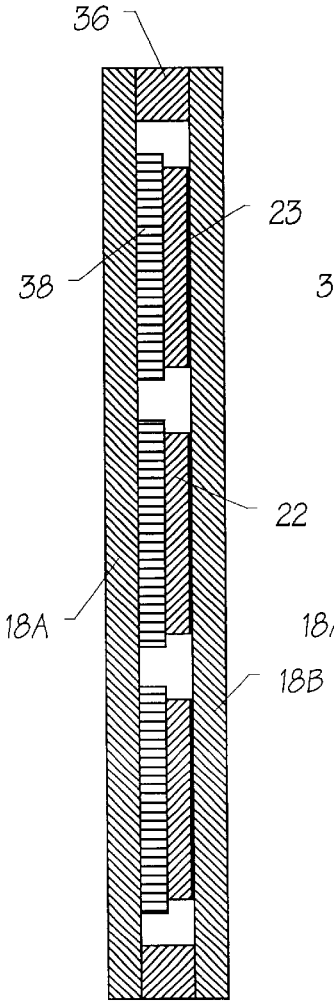

FIG. 12 shows another embodiment which is similar to the embodiment of FIG. 5, except that (a) a frame 10 and seals 20A,B are not provided, and instead the vibratable panels 18A,B are joined at their edges by a peripheral sealing member 36 between the vibratable panels 18A,B, and (b) the piezoelectric actuators 22 are not bonded by adhesive 23 directly to the vibratable panel 18A, but instead are acoustically coupled to the vibratable panel 18A by respective intermediate layers 38. The intermediate layers 38 have larger lateral dimensions than their respective piezoelectric actuators 22 and are of a material which has substantially the same stiffness as the piezoelectric actuators 22 and a greater stiffness than the panel 18A. It has been found that these intermediate layers 38 can provide more effective acoustic coupling between the piezoelectric actuators 22 and the panel 18A.

It will be appreciated that, in addition to the steps described above which can be taken to affect the overall frequency response of the transducer, with the embodiment of FIG. 12, the overall frequency response can also be affected by the choice of the size, thickness and stiffness of the intermediate layers 38.

Figure 13:
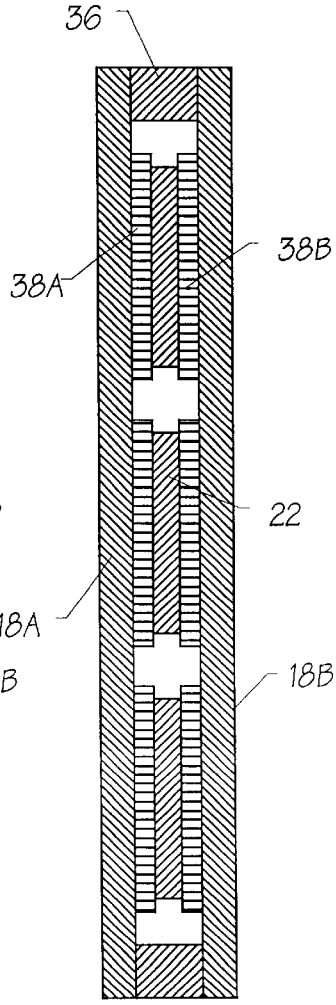

FIG. 13 shows yet another embodiment which is similar to the embodiment of FIG. 12, except that such intermediate layers 38A,B are provided between the piezoelectric actuators 22 and both of the vibratable panels 18A,B. With this embodiment, the transfer function of the transducer can be improved, and yet the overall frequency response can be flattened by employing a variety of intermediate layers 38 having different characteristics.

Figure 14:
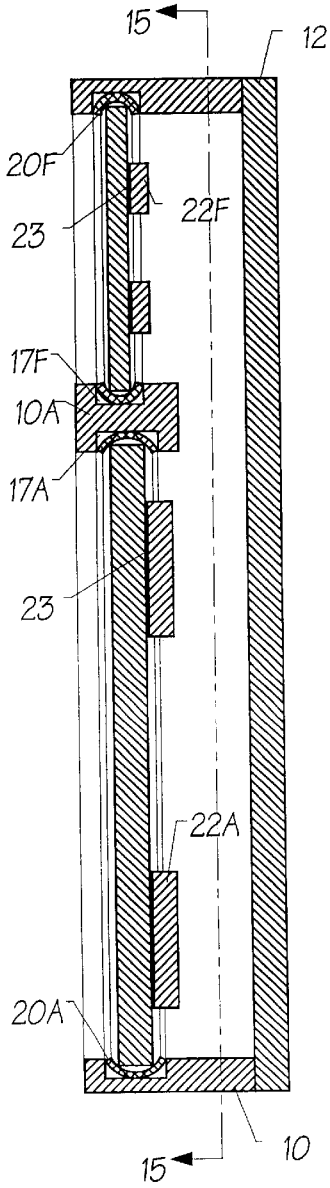
FIG. 14 is a sectioned side view of another embodiment of electro-acoustic transducer, taken along the section line 14—14 in FIG. 15.
Figure 15:
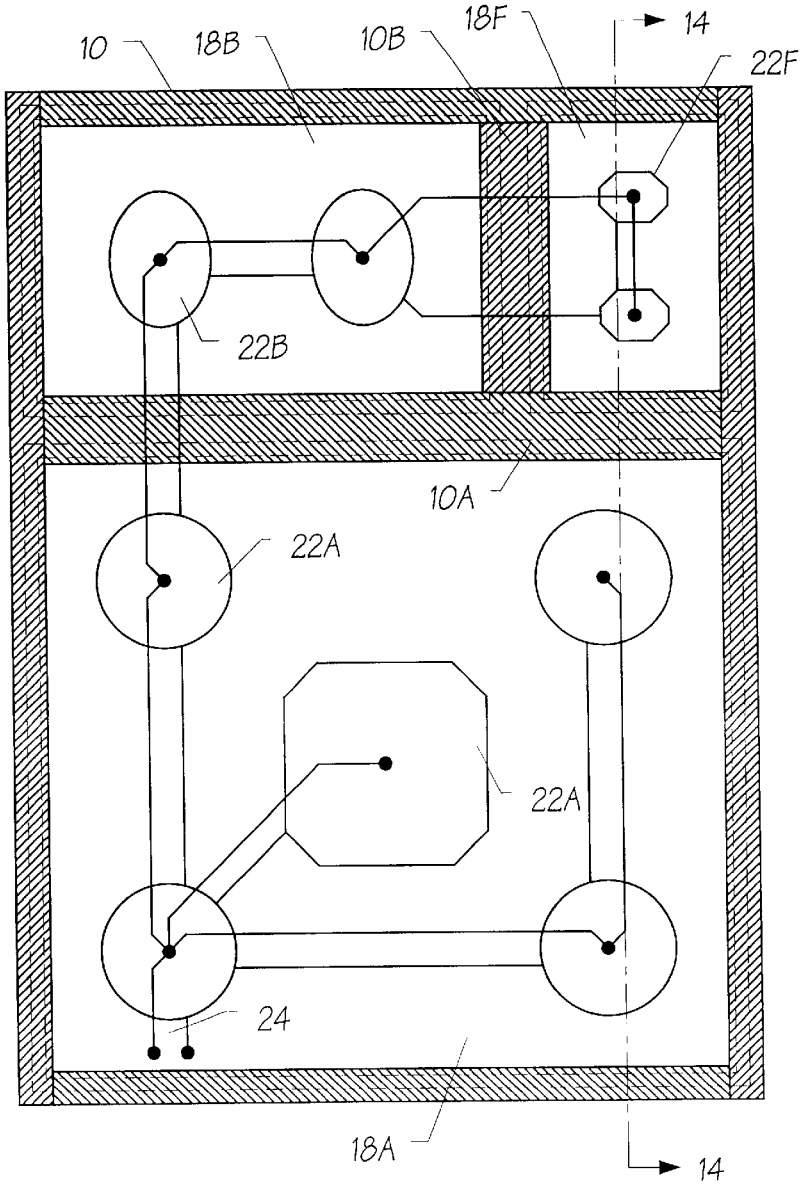
FIG. 15 is a sectioned rear view of the electro-acoustic transducer of FIG. 14, taken along the section line 15—15 in FIG. 14.

FIGS. 14 and 15 show a further embodiment which is similar to the embodiment of FIGS. 1 and 2, except that three such vibratable panels 18A,B,F of decreasing size are provided, arranged side by side. The frame 10 has a first horizontal dividing member 10A below which the larger vibratable panel 18A is located and above which the medium-sized and smaller panels 18B,F are located. The frame 10 also has a second vertical dividing member 10B between the medium-sized panel 18B and the smaller panel 18F. The frame 10,10A,B provides channels 17A,B,F which receive seals 20A,B,F around the edges of the three panels 18A,B,F. Various shapes and sizes of piezoelectric actuators 22A,B,F are bonded by adhesive 23 to the three vibratable panels 18A,B,F, and the piezoelectric actuators 22A,B,F are connected together by wires 24 in parallel so that the three panels 18A,B,F vibrate in-phase. As may be appreciated, the three panels 18A,B,F will provide their highest responses in the lower, mid and upper portions, respectively, of the audio spectrum.

In the embodiments described above with respect to FIGS. 5 to 15, identical in-phase signals are applied to the piezoelectric actuators, and the vibratable panels 18 are arranged to vibrate in phase with each other. Other arrangements may be employed. For example, the embodiment of FIGS. 14 and 15 may be modified to include a conventional passive 3-way crossover circuit having a common input and a low-range output connected to the piezoelectric actuators 22A of the larger vibratable panel 18A, a mid-range output connected to the piezoelectric actuators 22B of the medium-sized panel 18B and a high-range output connected to the piezoelectric actuators 22F of the smaller vibratable panel 18F. Other, more elaborate, circuits may also be used to alter the phases, amplitude and/or frequencies of the signals applied to the actuators on different vibratable panels, and indeed on the same vibratable panel, so as to achieve a desired frequency response for the transducer as a whole in the listening space in which it is situated.

Also, some of the embodiments described above may be modified so that pairs of the vibratable panels vibrate in anti-phase with respect to each other. This may be desirable when the electroacoustic transducer is situated near to an acoustically reflective surface such as a wall. Sound generated by the vibratable panel which is facing towards the wall will be reflected off the wall and will interfere, constructively and/or destructively, with the sound generated by the vibratable panel which is facing away from the wall. In some cases, a simple anti-phase relationship between the vibrations of the forwardly and rearwardly facing vibratable panels will produce good results. In other cases, the phase-frequency relationship between the vibrations of the forwardly and rearwardly facing panels may be tailored by more complex circuitry in order to achieve better results.

In one embodiment which achieves a simple anti-phase relationship between the vibrations of the forwardly and rearwardly facing panels, the embodiment described above with reference to FIG. 10 is modified so that the stacks 32 of layers 34 of piezoelectric material expand and contract in the direction between the vibratable panels 18A,B in response to the applied electrical signal, rather than bending. Accordingly, the panels 18A,B will vibrate in anti-phase.

Figure 16:
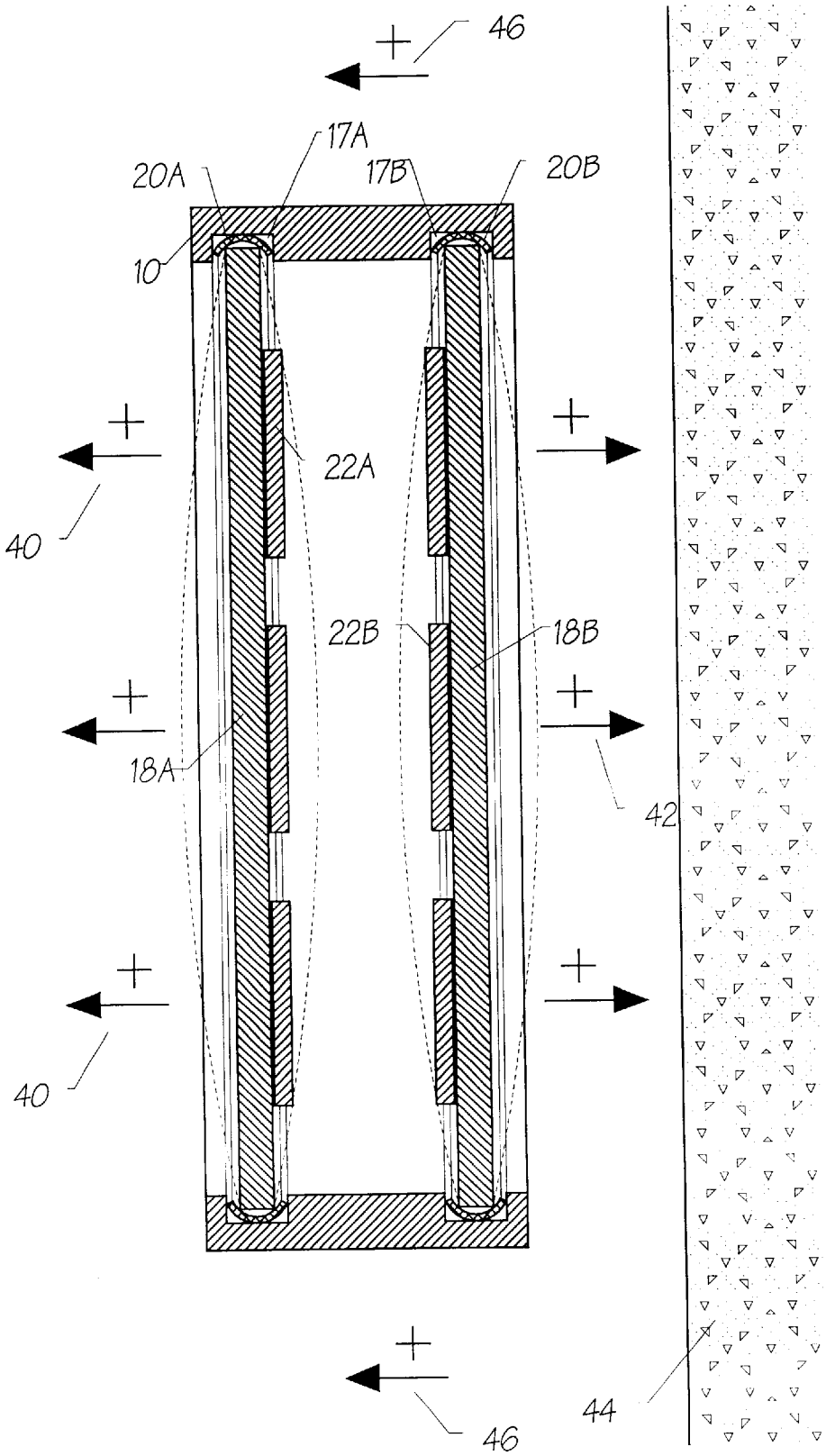
FIG. 16 is similar to FIG. 11, but showing the transducer adjacent a wall.

In another embodiment which achieves the simple anti-phase relationship, the embodiment of FIG. 11 is modified by reversing the electrical connections to each of the piezoelectric actuators 22B attached to the rearwardly facing vibratable panel 18B. Accordingly, referring to FIG. 16, when the forwardly facing vibratable panel 18A responds to a fundamental signal to bend to the left, as shown by the arrows 40, the rearwardly facing vibratable panel 18B will respond to the same signal by bending to the right, as shown by the arrows 42. The rearwardly directed sound will be reflected by the acoustically reflective wall 44 to produce sound as indicated by the arrows 46 which will, when the transducer is situated close to the wall 44, constructively reinforce the sound generated by the forwardly directed vibratable panel 18A over most of the audio spectrum.

It should be noted that the embodiments of the invention have been described above purely by way of example and that many modifications and developments may be made to them.

For example, the intermediate layers 38 described with reference to FIGS. 12 and 13 may be used with any of the other embodiments of the invention. Also, the seals 20,20A,B described above with reference to FIGS. 1 to 11 and 14 to 16 may be employed in the embodiments of FIGS. 12 and 13, and the sealing members 36 described above with reference to FIGS. 12 and 13 may be used with the other embodiments.

What is claimed is:

1. An electro-acoustic transducer, comprising:

a panel which can be vibrated to generate sound;

actuator means for receiving a driving signal and vibrating in response thereto;

coupling means for mechanically and acoustically coupling the panel to the actuator means at one or more locations remote from the edges of the panel so that the panel vibrates, in response to vibration of the actuator means, in a multi-modal, non-pistonic, bending manner with substantially no bodily translational movement of the panel;

a frame for mounting the panel; and a seal arranged between the frame and the edges of the panel for holding the panel in the frame, substantially isolating the frame acoustically from the edges of the panel, and substantially sealing the frame to the edges of the panel.

2. A transducer as claimed in claim 1, wherein the seal comprises a strip of flexible resilient material.

3. A transducer as claimed in claim 2, wherein the strip is arranged to wrap around the edges of the panel.

4. A transducer as claimed in claim 3, wherein the strip is formed from a length of resilient tubing cut lengthwise and opened to claim over the edges of the panel.

5. A transducer as claimed in claim 3, wherein the strip is received in a channel in the frame, and the strip has a channel which receives the edges of the panel.

6. A transducer as claimed in claim 2, wherein the strip is received in a channel in the frame, and the strip has a channel which receives the edges of the panel.

7. A transducer as claimed in claim 6, wherein the strip is formed from a length of resilient tubing cut lengthwise and opened to claim over the edges of the panel.

8. A transducer as claimed in claim 1, wherein the coupling means is provided by bonding a portion of the actuator means to the panel.

9. A transducer as claimed in claim 1, wherein the coupling means comprises a passive intermediate layer disposed between a portion of the actuator means and the panel.

10. A transducer as claimed in claim 9, wherein the actuator means comprises at least one piezo-electric actuator of a plurality of piezo-electric actuators and the passive intermediate layer has a greater stiffness than the panel and substantially the same stiffness as the at least one piezo-electric actuator.

11. A transducer as claimed in claim 1, wherein the frame forms part of an enclosure disposed generally to one side of the panel.

12. A transducer as claimed in claim 1, further including:

a second panel which can be vibrated to generate sound and which is mounted to the frame;

second coupling means for mechanically and acoustically coupling the second panel to the first panel or the actuator means at one or more locations remote from the edges of the second panel so that the second panel also vibrates in response to vibration of the actuator means, in a multi-modal, non-pistonic, bending manner with substantially no bodily translational movement of the second panel; and a second seal arranged between the frame and the edges of the second panel for holding the second panel in the frame, substantially isolating the frame acoustically from the edges of the second panel, and substantially sealing the frame to the edges of the second panel.

13. A transducer as claimed in claim 12, wherein the first and second seals have different acoustic isolation properties.

14. A transducer as claimed in claim 7, wherein the first and second panels have different acoustic properties.

15. A transducer as claimed in claim 7, wherein the first and second coupling means have different acoustic coupling properties.

16. A transducer as claimed in claim 12, wherein the panel and the second panel are arranged face-to-face.

17. A transducer as claimed in claim 12, wherein the second coupling means is arranged to couple the second panel mechanically and acoustically to the panel.

18. A transducer as claimed in claim 17, wherein the second panel has at least one aperture therein which receives the actuator means.

19. A transducer as claimed in claim 16, wherein the second coupling means is arranged to couple the second panel mechanically and acoustically to the actuator means.

20. A transducer as claimed in claim 19, wherein the actuator means is common to the panel and second panel.

21. A transducer as claimed in claim 20, wherein the actuator means comprises at least one piezo-electric actuator of a plurality of piezo-electric actuators bridging between the first and second coupling means.

22. A transducer as claimed in claim 21, wherein the at least one piezo-electric actuator of the plurality of piezo-electric actuators comprises a stack formed of layers of piezo-electric material.

23. A transducer as claimed in claim 21, wherein:

the plurality of such piezo-electric actuators are provided; and at least two piezo-electric actuators of the plurality of piezo-electric actuators have different electro-acoustic transducing properties.

24. A transducer as claimed in claim 21, wherein:

a plurality of such piezoelectric actuators are provided;

an electrical circuit is provided for receiving an input signal and for producing therefrom at least two output signals with different amplitudes, frequency characteristics and/or phases; and the output signals are supplied to different piezo-electric actuators of the plurality of piezo-electric actuators.

25. A transducer as claimed in claim 21, wherein the coupling means comprises a passive intermediate layer disposed between a portion of the actuator means and the panel and wherein the intermediate layer has larger lateral dimensions than the at least one piezo-electric actuator.

26. A transducer as claimed in claim 25, wherein the passive intermediate layer has a greater stiffness than the panel and substantially the same stiffness as the at least one-piezoelectric actuator.

27. A transducer as claimed in claim 19, wherein the actuator means comprises:

a first actuator means which is coupled by the first coupling means to the first panel; and second actuator means which is coupled by the second coupling means to the second panel.

28. A transducer as claimed in claim 27, wherein the first and second actuator means each comprise at least one piezo-electric actuator of the plurality of piezo-electric actuators.

29. A transducer as claimed in claim 28, wherein:

the plurality of such piezo-electric actuators are provided; and at least two piezo-electric actuators of the plurality of piezo-electric actuators have different electro-acoustic transducing properties.

30. A transducer as claimed in claim 28, wherein: a plurality of such piezo-electric actuators are provided;

an electrical circuit is provided for receiving an input signal and for producing therefrom at least two output signals with different amplitudes, frequency characteristics and/or phases; and the output signals are supplied to different piezo-electric actuators of the plurality of piezo-electric actuators.

31. A transducer as claimed in claim 12, wherein:

the panel and the second panel are arranged side-by-side; and the second coupling means is arranged to couple the second panel mechanically and acoustically to the actuator means.

32. A transducer as claimed in claim 31, wherein the actuator means comprises:

a first actuator means which is coupled by the first coupling means to the first panel; and second actuator means which is coupled by the second coupling means to the second panel.

33. A transducer as claimed in claim 32, wherein the first and second actuator means each comprise at least one piezo-electric actuator of the plurality of piezo-electric actuators.

34. A transducer as claimed in claim 33, wherein:

the plurality of such piezo-electric actuators are provided; and at least two piezo-electric actuators of the plurality of piezo-electric actuators have different electro-acoustic transducing properties.

35. A transducer as claimed in claim 33, wherein:

a plurality of such piezoelectric actuators are provided;

an electrical circuit is provided for receiving an input signal and for producing therefrom at least two output signals with different amplitudes, frequency characteristics and/or phases; and the output signals are supplied to different piezo-electric actuators of the plurality of piezoelectric actuators.

36. A transducer as claimed in claim 12, wherein the panel and second panel are arranged to vibrate substantially in phase with each other.

37. A transducer as claimed in claim 12, wherein the panel and the second panel are arranged to vibrate substantially in anti-phase with each other.

38. A transducer as claimed in claim 12, further including at least one further panel arranged face-to-face with respect to the panel.

39. A transducer as claimed in claim 12, further including at least one other panel arranged side-by-side with respect to the panel.

40. An electro-acoustic transducer, comprising:

first and second panels each of which can be vibrated to generate sound;

actuator means for receiving a driving signal and vibrating in response thereto;

first coupling means for mechanically and acoustically coupling the first panel to the actuator means at one or more locations remote from the edges of the first panel so that the first panel vibrates in response to vibration of the actuator means, in a multi-modal, non-pistonic, bending manner with substantially no bodily translational movement of the first panel;

second coupling means for mechanically and acoustically coupling the second panel to the first panel and/or the actuator means at one or more locations remote from the edges of the second panel so that the second panel also vibrates in response to vibration of the actuator means, in a multi-modal, non-pistonic, bending manner with substantially no bodily translational movement of the second panel.

41. A transducer as claimed in claim 40, wherein the first and second panels have different acoustic properties.

42. A transducer as claimed in claim 40, wherein the first and second coupling means have different acoustic coupling properties.

43. A transducer as claimed in claim 40, wherein the first panel and the second panel are arranged face-to-face.

44. A transducer as claimed in claim 43, wherein the second coupling means is arranged to couple the second panel mechanically and acoustically to the first panel.

45. A transducer as claimed in claim 44, wherein the second panel has at least one aperture therein which receives the actuator means.

46. A transducer as claimed in claim 43, wherein the second coupling means is arranged to couple the second panel mechanically and acoustically to the actuator means.

47. A transducer as claimed in claim 46, wherein the actuator means is common to the first and second panels.

48. A transducer as claimed in claim 47, wherein the actuator means comprises at least one piezo-electric actuator of a plurality of piezo-electric actuators bridging between the first and second coupling means.

49. A transducer as claimed in claim 48, wherein the at least one piezo-electric actuator comprises a stack formed of layers of piezo-electric material.

50. A transducer as claimed in claim 48, wherein:

the plurality of such piezoelectric actuators are provided; and at least two piezo-electric actuators of the plurality of piezo-electric actuators have different electro-acoustic transducing properties.

51. A transducer as claimed in claim 48, wherein:

a plurality of such piezo-electric actuators are provided;

an electrical circuit is provided for receiving an input signal and for producing therefrom at least two output signals with different amplitudes, frequency characteristics and/or phases; and the output signals are supplied to different piezo-electric actuators of the plurality of piezo-electric actuators.

52. A transducer as claimed in claim 46, wherein the actuator means comprises:

a first actuator means which is coupled by the first coupling means to the first panel; and second actuator means which is coupled by the second coupling means to the second panel.

53. A transducer as claimed in claim 52, wherein the first and second actuator means each comprise at least one piezo-electric actuator of the plurality of piezo-electric actuators.

54. A transducer as claimed in claim 53, wherein:

the plurality of such piezoelectric actuators are provided; and at least two piezo-electric actuators of the plurality of piezo-electric actuators have different electro-acoustic transducing properties.

55. A transducer as claimed in claim 53, wherein:

a plurality of such piezo-electric actuators are provided;

an electrical circuit is provided for receiving an input signal and for producing therefrom at least two output signals with different amplitudes, frequency characteristics and/or phases; and the output signals are supplied to different piezo-electric actuators of the plurality of piezo-electric actuators.

56. A transducer as claimed in claim 53, wherein the coupling means comprises a passive intermediate layer disposed between a portion of the actuator means and the first or second panels and wherein the intermediate layer has larger lateral dimensions than the at least one piezo-electric actuator.

57. A transducer as claimed in claim 56, wherein the passive intermediate layer has a greater stiffness than the first or second panels and substantially the same stiffness as the at least one piezo-electric actuator.

58. A transducer as claimed in claim 40, wherein:

the first panel and the second panel are arranged side-by-side; and the second coupling means is arranged to couple the second panel mechanically and acoustically to the actuator means.

59. A transducer as claimed in claim 58, wherein the actuator means comprises:

a first actuator means which is coupled by the first coupling means to the first panel; and second actuator means which is coupled by the second coupling means to the second panel.

60. A transducer as claimed in claim 59, wherein the first and second actuator means each comprise at least one piezo-electric actuator of the plurality of piezo-electric actuators.

61. A transducer as claimed in claim 60, wherein:

the plurality of such piezo-electric actuators are provided; and at least two piezo-electric actuators of the plurality of piezo-electric actuators have different electro-acoustic transducing properties.

62. A transducer as claimed in claim 60, wherein:

a plurality of such piezo-electric actuators are provided;

an electrical circuit is provided for receiving an input signal and for producing therefrom at least two output signals with different amplitudes, frequency characteristics and/or phases; and the output signals are supplied to different piezo-electric actuators of the plurality of piezoelectric actuators.

63. A transducer as claimed in claim 40, wherein the first and second panels are arranged to vibrate substantially in phase with each other.

64. A transducer as claimed in claim 40, wherein the first and second panels are arranged to vibrate substantially in anti-phase with each other.

65. A transducer as claimed in claim 40, further including at least one further panel arranged face-to-face with respect to the first panel.

66. A transducer as claimed in claim 40, further including at least one other panel arranged side-by-side with respect to the first panel.

67. A transducer as claimed in claim 40, wherein at least one of the first or second coupling means is provided by bonding a portion of the actuator means to the first or second panels.

68. A transducer as claimed in claim 40, wherein the coupling means comprises a passive intermediate layer disposed between a portion of the actuator means and the first or second panels.

* * * * *